United States Patent [19]

Miller

[11] Patent Number: 4,652,363

[45] Date of Patent: Mar. 24, 1987

[54] DUAL FEED HYDROCYCLONE AND METHOD OF SEPARATING AQUEOUS SLURRY

[76] Inventor: Francis G. Miller, P.O. Box 501 -- 3 Wild View Dr., Ligonier, Pa. 15658

[21] Appl. No.: 667,127

[22] Filed: Nov. 1, 1984

[51] Int. Cl.[4] ..... B04C 5/04

[52] U.S. Cl. ..... 209/211; 210/512.1

[58] Field of Search ..... 209/211, 144, 3; 210/512.1, 512.2, 788; 55/1, 419, 459 R, 459 A, 459 B, 459 C, 459 D

[56] References Cited

U.S. PATENT DOCUMENTS

| | | | |
|---|---|---|---|
| 755,430 | 3/1904 | Allington | 55/1 |
| 1,961,956 | 6/1934 | Bleibtreu et al. | 55/419 X |
| 2,005,305 | 6/1935 | Wagner | 55/419 X |
| 2,364,405 | 12/1944 | Trimbey et al. | 210/512.1 X |
| 2,653,801 | 9/1953 | Fontein et al. | 259/4 |
| 2,767,840 | 10/1956 | Dobson et al. | 209/144 |
| 3,507,397 | 4/1970 | Robinson | 210/512 |
| 4,067,814 | 1/1978 | Surakka et al. | 209/211 X |
| 4,090,956 | 5/1978 | Benzon | 209/211 |

FOREIGN PATENT DOCUMENTS 315266 9/1969 Sweden .

*Primary Examiner*—S. Leon Bashore
*Assistant Examiner*—Thomas M. Lithgow
*Attorney, Agent, or Firm*—Harry B. Keck

[57] ABSTRACT

A duel feed hydrocyclone is proposed for separating an aqueous slurry of particles into a bottom stream which contains the heavy/large particles and a top stream which contains the light/small particles. The aqueous slurry is delivered through a common feed conduit and is divided into two initially parallel horizontally spaced-apart streams. The first stream enters the cylindrical chamber of the hydrocyclone through a side wall opening near the top thereof; the second feed stream is delivered around the outer surface of the cylindrical chamber and is introduced into the cylindrical chamber through a second side wall opening, remote from the first side wall opening. The heavy/large particles of the slurry descend adjacent to the inner wall of the hydrocyclone in helical paths which are distinct from one another. Some particle segregation occurs in the second passageway prior to introduction of the second partial feed stream into the hydrocyclone.

7 Claims, 8 Drawing Figures

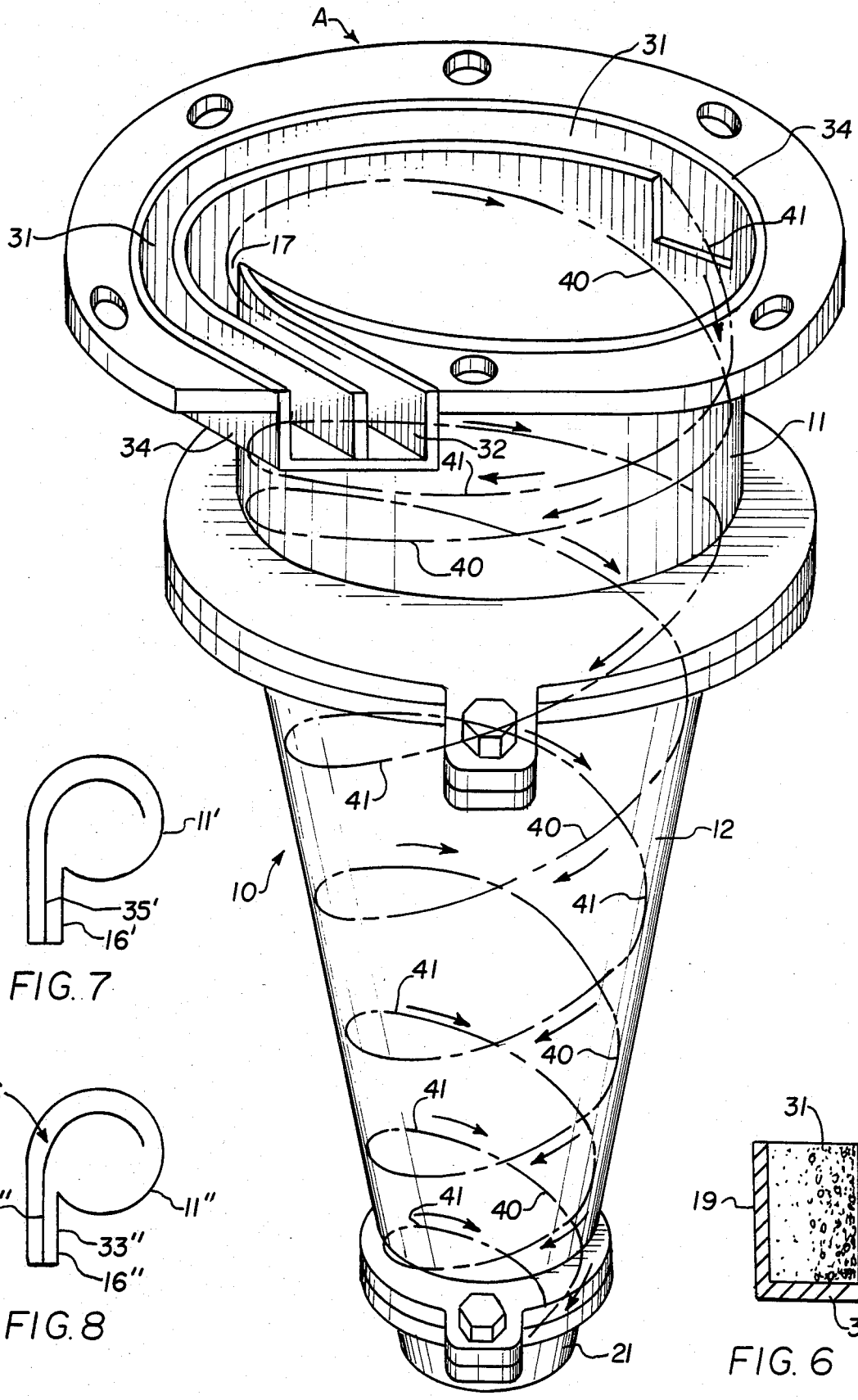
FIG. 5
FIG. 7
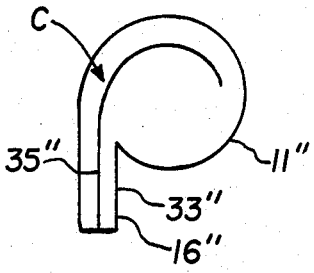
FIG. 8
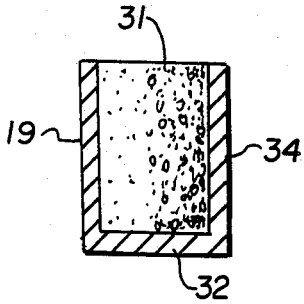
FIG. 6

DUAL FEED HYDROCYCLONE AND METHOD OF SEPARATING AQUEOUS SLURRY

BACKGROUND OF THE INVENTION

1. Field of the Invention

This invention concerns methods and hydrocyclone apparatus which are employed to separate two types of solid particles from an aqueous slurry containing both types of particles. More particularly the present invention concerns a hydrocyclone having a dual feed inlet for aqueous slurry.

2. Description of the Prior Art

Hydrocyclones are employed to separate heavy particles from lighter particles and to separate large particles from smaller particles. The heavy/large particles have greater mass than the light/small particles. Hydrocyclones are of particular value in the coal cleaning industry where the ash-rich particles of raw coal (relatively heavy—i.e., higher density) are separated from the low ash particles (relatively light—i.e., lower density).

The hydrocyclone employs the fluid pressure of the slurry to create rotational movement within a cylindrical chamber. The outlets, top and bottom, are centrally located whereby the liquid moves in a spiral path to leave the hydrocyclones. One type of suspended solid particle (heavy/large) moves outwardly and downwardly while the other type of suspended solid particle (light/small) moves radially inwardly. The rotation of aqueous slurry within the hydrocyclone is initiated by the tangential injection of the slurry into the hydrocyclone. While hydrocyclones are normally positioned with the inlet/outlet axis vertical, other dispositions are known and are effective since the gravitational forces are relatively insignificant in the operation of the hydrocyclone.

Hydrocyclones having two feed inlet openings are described in U.S. Pat. No. 4,090,956 wherein two separate feed inlets are provided diametrically opposed to each other across a cylindrical section of a hydrocyclone. One of the described objectives of the dual feed inlet hydrocyclone is to provide more uniform wear of the inner wall of the apex cone of the hydrocyclone.

The dual feed inlet hydrocyclone of the prior art, having the separate feed conduits, presents serious installation, operating and maintenance problems.

Hydrocyclones are known wherein the aqueous slurry feed inlet stream is introduced through a single feed conduit which is tangential to the cylindrical surface of the cylindrical portion of the hydrocyclone along (a) the center line of the feed conduit; (b) the adjacent surface of the feed conduit; (c) the remote surface of the feed conduit; or (d) some other line between the surfaces of the feed conduit. See "The Hydrocyclone," D. Bradley, Pergamon Press, 1965, page 119.

STATEMENT OF THE INVENTION

According to the present invention, a hydrocyclone is provided having a cylindrical portion defining a cylindrical chamber connected to and in open communication at its base with a conical portion defining a conical chamber. The hydrocyclone has an outlet at the lower apex end of the conical chamber for removal of water and heavy/large particles. The hydrocyclone has a vortex finder in the cylindrical chamber consisting of a vertical pipe extending through the top wall of the hydrocyclone for withdrawing water and light/small particles through an outlet. Typically the hydrocyclone is lined with wear-resistant materials such as elastomers or ceramics.

According to the present invention the aqueous slurry inlet feed is introduced into a single feed conduit which is generally rectangular in cross-section and which communicates with two different openings in the cylindrical side wall, the openings being approximately diametrically opposed to each other. In a preferred embodiment, a vertical separator wall serves as a splitter means to divide the incoming aqueous slurry feed into two side-by-side streams, each having a rectangular cross-section. The inner stream enters the cylindrical chamber through a first opening in the side wall of the cylindrical portion of the hydrocyclone; the outer stream is delivered in an arcuate path around the exterior of the cylindrical portion and enters through the cylindrical chamber through a second opening in the side wall of the cylindrical portion. In one alternative embodiment, the second opening is disposed vertically downwardly from the first opening. The aqueous slurry in the outermost stream, traversing an arcuate path, is exposed to some horizontal stratification with some heavy/large particles moving to the outside conduit wall and some light/small particles remaining in the aqueous suspension adjacent to the inside conduit wall.

Within the hydrocyclone, the heavy/large particles from the first stream move in a descending helical path over the inner wall of the hydrocyclone to be discharged through the apex opening of the conical portion. The heavy/large particles from the second stream likewise move in a descending a helical path over the inner wall of the hydrocyclone—a path which is different from the helical path of the heavy/large particles from the first stream. In this fashion, the abrasion resulting from the turbulent movement of the heavy/large particles against the inner wall of the hydrocyclone is not concentrated in a single descending helical path but instead is spread over the entire inner surface of the hydrocyclone. This improvement of dual feed hydrocyclones has been reported in the Benzon U.S. Pat. No. 4,090,956 supra. The effect of wear on the performance of the hydrocyclone is less significant since the wear is uniform. Prior art hydrocyclones with a single inlet feed stream tend to lose efficiency as a result of their irregular internal wear patterns. Thus the useful life of the linings of such single feed units is further decreased or loss of effectiveness must be accommodated elsewhere in the installation.

The improved method of the present invention separates an aqueous slurry into two side-by-side partial feed streams and delivers a first partial feed stream through a first side wall opening in a cylindrical chamber in a horizontal path which is essentially tangential to the side wall of the cylindrical chamber; delivers the second partial feed stream around the cylindrical chamber and through a second side wall opening which is remote from the first side wall opening in a horizontal path which is essentially tangential to the wall of the cylindrical chamber. The heavy/large particles from the slurry move helically downwardly adjacent to the inner wall of the hydrocyclone along generally separate paths for recovery through an outlet in the apex of the hydrocyclone. The light/small particles are recovered overhead through an outlet in the middle region of the cylindrical chamber.

An appropriate single transition piece is provided to convert the round cross-section of the conventional aqueous slurry delivery conduit to the rectangular cross-section of the aqueous slurry feed conduit.

The principal object of this invention is to provide a hydrocyclone which experiences less interior wall surface abrasion than conventional hydrocyclones and has an improved and simplified piping installation arrangement and procedure when compared with the dual inlet feed hydrocyclone of the prior art. Accordingly the present dual inlet hydrocyclone can be employed directly as a substitute for existing single-inlet feed hydrocyclones without requiring extensive changes in the piping arrangement of an existing hydrocyclone installation.

A further object of the invention is to achieve preliminary particle segregation according to weight/size in a second feed passageway for a hydrocyclone by directing the aqueous slurry stream in the second passageway through an arcuate path prior to introduction into the cylindrical portion of the hydrocyclone.

DESCRIPTION OF THE DRAWINGS

FIG. 5 is a perspective schematic illustration of the present dual inlet feed hydrocyclone illustrating the differing descending helical paths available for movement of the heavy/large particles along the interior wall of the hydrocyclone.

FIG. 6 is a schematic cross-section view of the second feed passageway taken along the line 6—6 of FIG. 2.

FIGS. 7 and 8 are schematic views showing alternative communications between a feed conduit and a vortex chamber.

DESCRIPTION OF THE PREFERRED EMBODIMENTS

Figure 1:
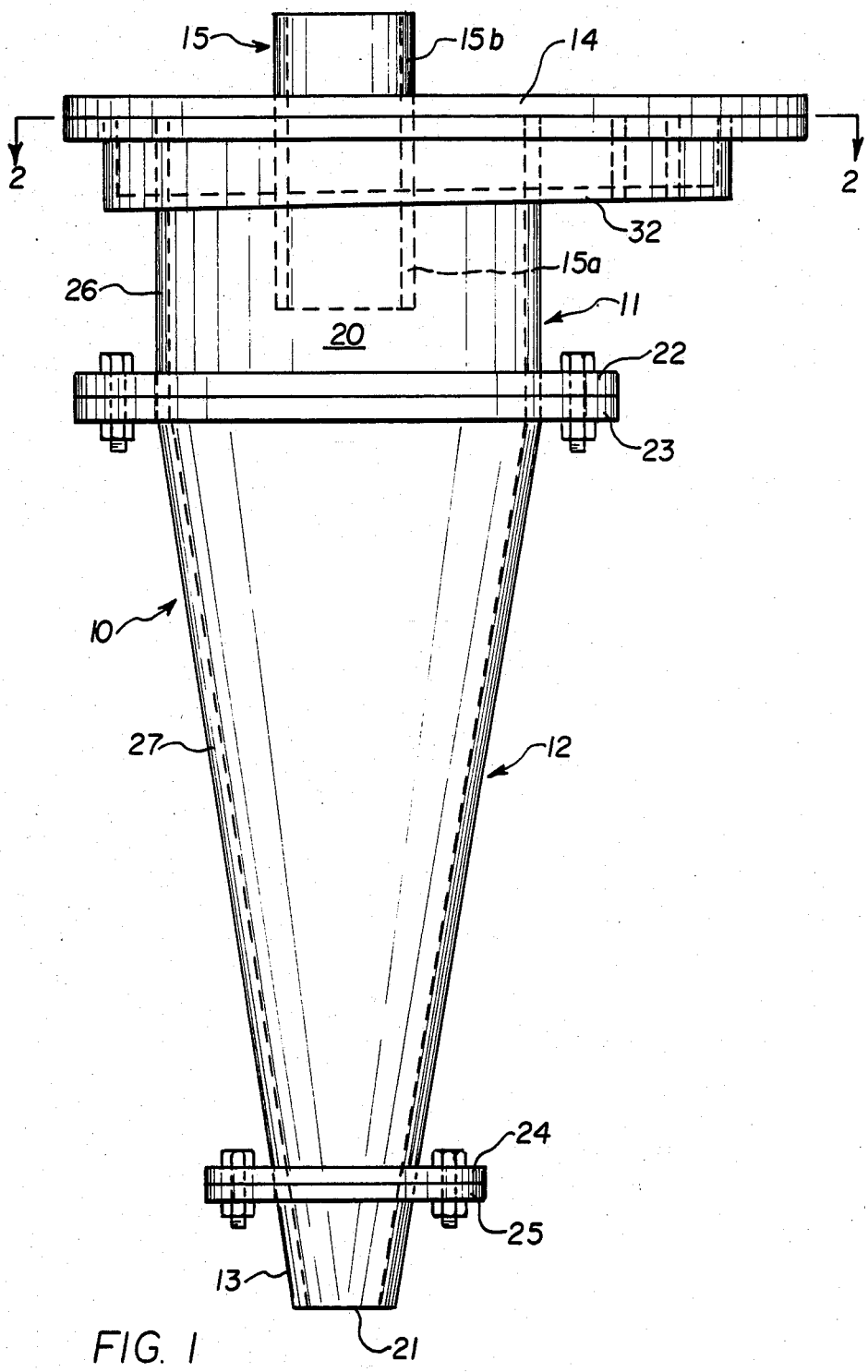
FIG. 1 is a side elevation of a dual inlet feed hydrocyclone according to this invention.

A hydrocyclone 10 includes a cylindrical body portion 11 and a conical portion 12 terminating in an apex unit 13. The hydrocyclone has a top wall 14 through which a vortex finder/outlet pipe 15 extends. The vortex finder 15-a is positioned at its lower edge in the middle region 20 of the cylindrical body portion 11. The outlet pipe 15-b extends upwardly through an opening in the top wall 14 to discharge water and light/small particles. An inlet feed conduit 16 introduces aqueous slurry through openings 17, 18 in the cylindrical side wall 19 of the cylindrical body portion 11. Aqueous slurry in the cylindrical body portion 11 is segregated with the heavy/large particles moving toward the cylindrical side wall 19 and the light/small particles accumulating in the middle region 20 of the cylindrical body portion 11 for removal upwardly throught the vortex finder/discharge pipe 15. The heavy/large particles descend downwardly through the conical portion 12 adjacent to the inner wall thereof in a helical pattern of decreasing radius until the heavy/large particles along with some of the water from the slurry are discharged through the bottom aperture 21 of the apex unit 13.

Figure 4:
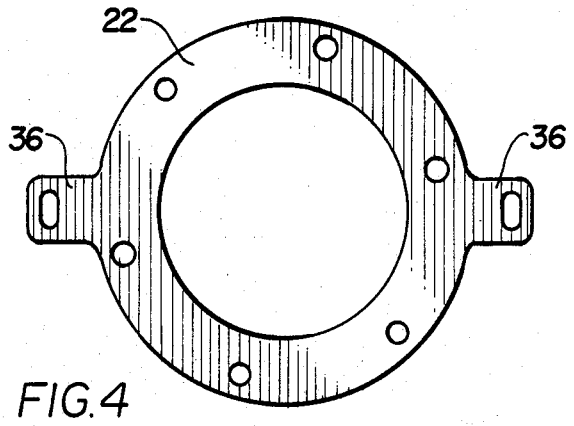
FIG. 4 is a plan view of a bottom flange of the cylindrical portion of the hydrocyclone of FIG. 1 taken along the line 4—4 of FIG. 3.

The cylindrical portion 11 has a bottom ring-like flange 22 (FIG. 4) which engages a corresponding flange 23 of the conical portion 12. The conical portion 12 has a bottom flange 24 which engages a corresponding flange 25 of the apex unit 13. Customarily the inner walls of the cylindrical body portion 11 and the conical unit 12 are coated with a liner material 26, 27 such as an appropriate abrasion-resistant substance which may be rubber, synthetic rubber, polyurethane elastomers, other organic elastomers, ceramic materials such as silicon carbide and the like.

Figure 2:
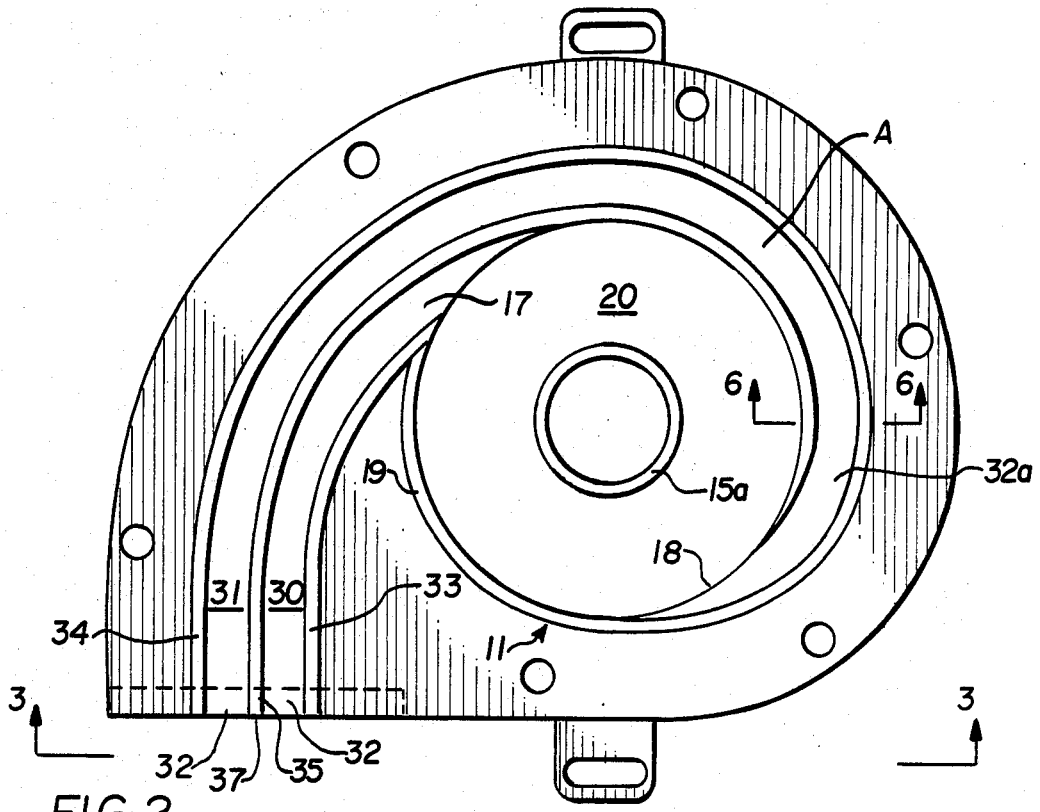
FIG. 2 is a plan view of the cylindrical portion of the hydrocyclone of FIG. 1 taken along the line 2—2 of FIG. 1.

The inlet feed conduit 16 as shown in FIG. 2 is preferably divided into a first passageway 30 and a second passageway 31. The conduit 16, as shown in FIG. 2, 3, is formed from a bottom wall 32 and side walls 33, 34. The cover plate 14 (FIG. 3) forms the top wall of the conduit 16. Preferably a vertical central wall 35 divides the conduit 16 into the two side-by-side passageways 30, 31. It will be observed that the first passageway 30 moves in an arcuate direction toward the cylindrical wall 19 of the cylindrical body portion 11 and communicates with the first opening 17 in the cylindrical wall 19. The vertical central wall 35 is a convolute surface merging with the cylindrical wall 19.

The vertical central wall 35 functions as a feed stream splitter and may have a knife-edge end directed toward the incoming feed stream, i.e., the face 37 (FIG. 3) may have a knife-edge instead of a flat surface as shown. The vertical central wall 35 may be formed from metal such as steel, particularly high nickel content steel, or from wear-resistant ceramic materials such as silicon carbide, alumina, silica-alumina and the like.

The second passageway 31 forms an arcuate path which communicates with the cylindrical body portion 11 through the second opening 18 in the cylindrical wall 19. The vertical separator wall 35 merges with the cylindrical wall 19 in the region indicated by the letter A. Thereafter the second passageway 31 is defined by the outer wall 34, the outer surface of the cylindrical wall 19, the bottom wall 32 and the cover plate 14.

The flange 22 (FIG. 4) is provided with tabs 36 which may serve as mounting brackets for the present hydrocyclone.

The inlet feed conduit 16 is illustrated as having a vertical central wall 35 to define the first and second passageways 30, 31, respectively. In an alternative embodiment, the vertical central wall 35 can be avoided and the inlet feed stream can be split at the region indicated by the letter A by the side wall 19 of the cylindrical body portion 11. A first portion of the inlet aqueous slurry will enter through the opening 17 and a second portion of the inlet slurry will enter through the second opening 18. When the vertical central wall 35 is employed, the inlet feed stream is preliminarily divided into two dedicated streams, each of which follows its separate passageway 30, 31.

It is not essential that the cross-sectional area of the two streams 30, 31 be identical.

An appropriate transition piece (not shown) should be provided to convert the normal circular cross-section piping which delivers aqueous slurry into the rectangular cross-section of the inlet feed conduit 16.

Figure 3:
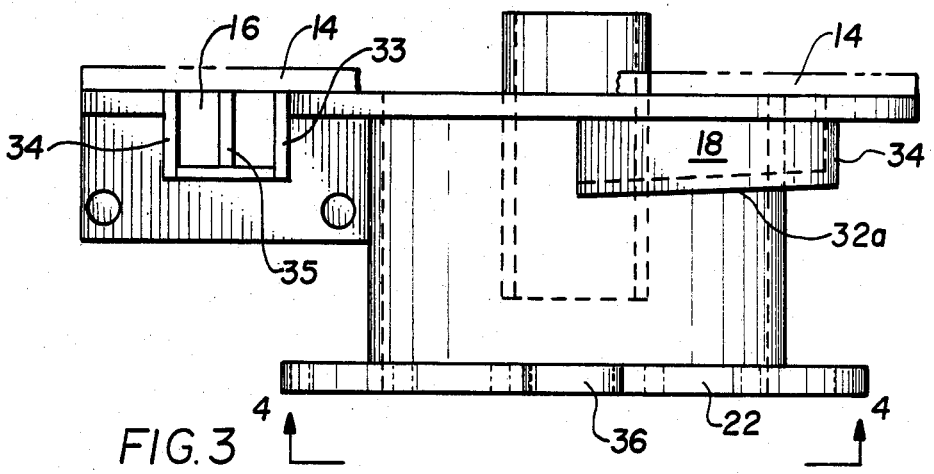
FIG. 3 is a side elevation of the cylindrical portion of the hydrocyclone of FIG. 1 taken along the line 3—3 of FIG. 2.

In a still further refinement of the invention, as illustrated in FIGS. 1 and 3, the second passageway 31 is provided with a downward sloping bottom wall 32-a whereby the second stream of aqueous slurry enters into the interior of the cylindrical body portion 11 at a level which is, in part, disposed below the entry level of the first stream. This feature directs the path of the downwardly descending helix of heavy/large particles.

Referring to FIG. 5, the heavy/large particles from the first aqueous slurry stream define a downwardly descending helix which develops, within the conical portion 12, a decreasing radius until the water and heavy/large particles are discharged through the bottom aperture 21. A similar downwardly descending helical path of heavy/large particles 41 is provided from the second passageway 31. The helices 40, 41 are distinct within the hydrocyclone 10. The result is that the abrasive wear on the inner lining of the hydrocyclone 10 follows two distinct helical paths 40, 41 thereby avoiding the wear localization of prior art single feed cyclones. Moreover, by dividing the throughput into two streams, the amount of wear in each of the two helical paths 40, 41 is reduced. There is an overall increase in the life expectancy of the hydrocyclone liner material 26, 27 and less deterioration of separating efficiency with wear as a result of the more uniform wear.

Referring to FIG. 6, it will be observed that the second passageway 31 achieves some particle stratification as a result of the arcuate path through which the second aqueous stream proceeds prior to introduction into the hydrocyclone through the second opening 18. The heavy/large particles are urged centrifically toward the outer wall 34 and the light/small particles remain in the middle region and adjacent to the inner wall 19 of the passageway 31.

FIG. 7 and 8 show alternative communications between a dual feed inlet conduit 16' (FIG. 7), 16" (FIG. 8) and a hydrocyclone cylindrical body portion 11' (FIG. 7), 11" (Fig. 8). In FIG. 7, the inlet feed conduit 16' communicates tangentially with the cylindrical body portion 11' with the vertical wall 35' being tangential to the wall of the cyclindrical body portion 11'. In FIG. 8, the side wall 33" is tangential to the cylindrical wall of the cylindrical body portion 11" and the central vertical wall 35" curves toward the cylindrical body portion 11" as shown at C.

I claim:

1. In a hydrocyclone for separating an aqueous slurry into two fraction, the combination of a generally cylindrical chamber communicating at its base with a conical chamber, a first outlet at the lower apex end of said conical chamber, a second outlet comprising a pipe extending downwardly into the middle region of said cylindrical chamber, an unobstructed annular chamber between said pipe and the inner wall of said cylindrical chamber, an aqueous slurry feed conduit, splitter means within said feed conduit for dividing the cross-sectional area into a first generally horizontal passageway and a second generally horizontal passageway, said passageways being side-by-side and directed toward the said cylindrical chamber, said cylindrical chamber communicating tangenially with said first passageway through a first side wall opening, a second side wall opening in the upper portion of said cylindrical chamber remote from said first side wall opening, said second passageway extending outside said upper portion of said cylindrical chamber and tangentially communicating with said second side wall opening.

2. The hydrocyclone of claim 1 wherein the said splitter reans forms a wall surface of said first passageway and also forms a wall surface of said second passageway.

3. The hydrocylone of claim 2 wherein one wall of said second passageway is formed from the said splitter means and a portion of the side wall of said cylindrical chamber.

4. The hydrocyclone of claim 1 wherein the said slurry feed conduit has a straight flow portion and a curved flow portion which is adjacent to the said cylindrical chamber.

5. The hydrocylone of claim 1 wherein the said second passageway has its bottom surface descending to a level of the said cylindrical side wall which is below the level of the bottom surface of said first passageway.

6. A method of separating an aqueous slurry in a hydrocyclone into two fractions which comprises introducing said slurry into a generally horizontal aqueous slurry feed conduit, splitting said feed stream vertically within said conduit into two side-by-side partial feed streams thereby defining first and second generally horizontal passageways, delivering the first partial feed stream through a first side wall opening in a cylindrical chamber of said hydrocyclone in a horizontal path essentially tangential to the side wall of said cylindrical chamber via said first horizontal passageway; delivering the second partial feed stream around the said cylindrical chamber and through a second side wall opening of said hydrocylone, remote from said first side wall opening, in said cylindrical chamber in a horizontal path essentially tangential to the side wall of said cylindrical chamber via said second passageway; moving said aqueous slurry uninterruptedly through the said cylindrical chamber; recovering one aqueous slurry fraction from the middle region of said cylindrical chamber through the top thereof; converging aqueous slurry from the bottom of said cylindrical chamber through a conical chamber and recovering a second aqueous slurry fraction product through a bottom outlet in the apex of said conical chamber.

7. In the method of separating an aqueous slurry as described in claim 6, directing the first partial feed stream from said first passageway along a generally helical first path over the inside surface of the said cylindrical chamber and directing the second partial feed stream from the said second passageway along a generally helical second path over the inside surface of said cylindrical chamber wherein the said first path is different from the said second path.

* * * * *